United States Patent [19]

Strong et al.

[11] 3,965,022

[45] June 22, 1976

[54] PRESSURE-FIXABLE DEVELOPING POWDER

[75] Inventors: Doyle L. Strong, West Lakeland Township, Washington County; Curtis Dale Hargadine, Hastings, both of Minn.

[73] Assignee: Minnesota Mining and Manufacturing Company, St. Paul, Minn.

[22] Filed: June 29, 1973

[21] Appl. No.: 375,115

[52] U.S. Cl. ..... 252/62.1 P
[51] Int. Cl.[2] ..... G03G 9/00
[58] Field of Search ..... 252/62.1 P

[56] References Cited

UNITED STATES PATENTS

| | | | |
|---|---|---|---|
| 3,093,039 | 6/1963 | Rheinfrank | 252/62.1 P |
| 3,565,805 | 2/1971 | Jones et al. | 252/62.1 P |
| 3,669,885 | 6/1972 | Wright et al. | 252/62.1 P |
| 3,788,994 | 1/1974 | Wellman et al. | 252/62.1 P |
| 3,838,054 | 9/1974 | Trachtenberg et al. | 252/62.1 P |

*Primary Examiner*—Samuel W. Engle
*Assistant Examiner*—Peter A. Nelson
*Attorney, Agent, or Firm*—Alexander, Sell, Steldt & DeLaHunt

[57] ABSTRACT

A dry, pressure-fixable, developing powder comprising a thermoplastic component having a low creep compliance and a non-volatile component having a high creep compliance, wherein the low creep compliance material is present in a greater amount by volume than the other component.

7 Claims, 2 Drawing Figures

PRESSURE-FIXABLE DEVELOPING POWDER

This invention relates to a dry ink powder suitable for use in electrographic recording. More particularly, the invention relates to a developing powder which is pressure responsive so that it can be fixed as an imaging material to an image-bearing surface by the application of pressure.

Known developing powder (i.e., toner) formulations used in electrographic recording processes are generally permanently affixed to the substrate by heat. See, e.g., the developing powder described in Nelson, U.S. Patent No. 3,639,245 wherein the powder is described as being thermoplastic and heat-fusible in the range of 80° to 115° C. Other heat-fusible developing powders are described in U.S. Pat. Nos. 3,590,000, 3,577,345 and 3,694,359. Such heat-fusible powders are fixed after image formation by raising the temperature of the powder to its melting or softening point, causing the particles to coalesce, flow together and adhere permanently to the substrate.

Although such heat-fusing developing powders have been widely used and have met with commercial success, there are certain disadvantages which are inherent in the use of such powders. Such disadvantages relate to the speed and efficiency of the fixing process.

For example, the speed of the fixing process, and hence the speed of the copying or recording process, is limited by the time required to effect fusion of the developer powder. Although the use of more heat to fuse the powder may shorten the fixing time required, this approach is limited by the flammability of the substrate on which the image is fixed. Since paper is widely used as the image-bearing support, care must be taken to avoid charring of the paper during the fixing process. Although the speed of the fixing process may also be increased by using lower melting point thermoplastic resins, the resulting image may be smeary and may exhibit poor character definition.

Another disadvantage associated with the use of heat-fusible powders is the significant power consumption of the equipment used for fixing. A further disadvantage is the significant loss of heat energy to the environment.

Yet another disadvantage associated with the use of heat-fusible powders is that the fixing rolls or other equipment used for fixing must first be heated to the requisite temperature before the copying or recording process can begin.

These disadvantages are overcome with the use of the developing powder of this invention.

SUMMARY OF THE INVENTION

In accordance with the invention there are provided flowable, pressure-flexible, dry powder particles, the binder material of said particles having a conductivity of at most $10^{-12}$ mho/cm, said binder comprising (a) about 74 to 98 parts by volume of a thermoplastic component having a softening point of at least about 60° C., a 10-second shear creep compliance in the range of about $1 \times 10^{-9}$ cm²/dyne to $1 \times 10^{-13}$ cm²/dyne at room temperature, and a "heat deflection temperature" below about 300° C., and (b) about 2 to 26 parts by volume of a non-volatile component having a principal glass transition temperature below about 0° C. as measured by differential thermal analysis, and a 10-second shear creep compliance in the range of about 50 cm²/dyne to $8 \times 10^{-8}$ cm²/dyne at room temperature, said non-volatile component preferably being elastomeric; wherein the dry powder exhibits a "transfer density" of less than about 0.15 and a "paper abrasion density" of less than about 0.15, as hereinafter defined.

The developing powder of this invention is pressure-fixable. Consequently, the disadvantages associated with the use of heat-fusible developing powders are avoided. Furthermore, because of the significant power consumption reduction in processes using these powders, recording and copying processes become more versatile and economical.

Another advantage derived from the use of such powders is that there is no wait for the machine to warm up to operating temperature. Also, the equipment necessary for fixing the powders of this invention is less expensive and less complicated than conventional heat-fusing equipment. Consequently, the fixing equipment is more reliable and more easily serviced than conventional heat-fusing equipment.

The developing powders of this invention can be fixed directly to a photoconductive surface in an imagewise fashion, or they can be transferred to a receiving sheet (e.g., untreated bond paper) to which pressure is subsequently applied to fix the image. The powders are useful with known photoconductive materials, e.g., amorphous or vitreous selenium, selenium alloys with tellurium and arsenic, cadmium sulfide, zinc oxide in a resin binder, and organic photoconductive materials.

Although pressure-fixable developing powders have been suggested generally in British Pat. No. 1,210,665, the developing powder of the present invention represents an improvement thereover. This British patent generally suggests that an aliphatic wax can be used, either by itself or in admixture with a thermoplastic resin, as the developing powder. However, it has been found that all waxes and many blends of wax and resin produce developing powders which, although easily pressure-fixable, are commercially unacceptable due to their ease of smearing and "carbon paper" transfer. These waxes and thermoplastic resins are also exclusively low shear creep compliance materials. Also, the developing powders based on a blend of wax and resin generally tend to produce glossy images. The developing powders of the present invention alleviate these disadvantages.

The developing powders of this invention may also differ from those described in British Pat. No. 1.210,665 in another material respect, viz., in terms of electrical properties. The novel developing powders can be made to exhibit the highly desirable electrical properties described in U.S. Pat. No. 3,639,245, whereas the developing powders described in the aforementioned British patent are not electrically conductive. Consequently, the developing powders described in the British patent are useful only in conventional electrostatic copying processes wherein electroscopic toner powders are used. The developing powders of the present invention also differ from those in the British patent in that the present powders can be made from amorphous materials.

DETAILED DESCRIPTION OF THE INVENTION

Figure 1:
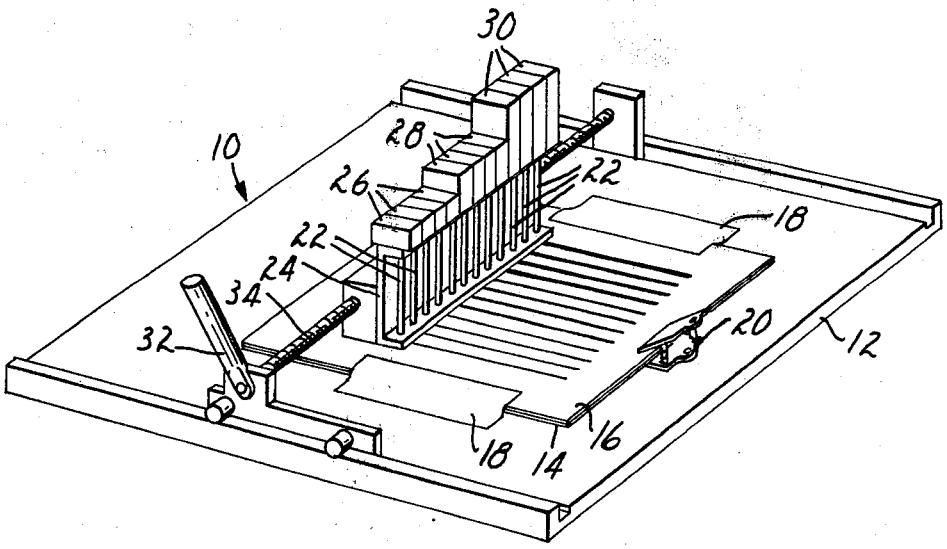
FIG. 1 contains apparatus for performing a "transfer density" measurement.

The developing powders of this invention have a number average diameter below about 20 microns, and preferably in the range of about 10–15 microns. Preferably, the average particle size range is such that at least about 95 number percent of the particles have a diameter greater than about 5 microns, while no more than about 5 number percent have a diameter greater than about 25 microns.

The developing powders are pressure-fixable in the sense that the application of pressure thereto causes them to adhere to one another and also to the desired support surface (i.e., the image-bearing surface). The binder material comprises a blend of one or more low creep compliance and one or more high creep compliance components wherein the volume ratio of low creep compliance material to high creep compliance material (calculated on the basis of their respective specific gravities before blending) is about 3/1 to 50/1 (preferably about 3/1 to 15/1), said binder material having a conductivity of no more than about $10^{-12}$ mho/cm. The low creep compliance materials exhibit a 10-second shear creep compliance in the range of about $1 \times 10^{-9}$ cm²/dyne to $1 \times 10^{-13}$ cm²/dyne at room temperature, and preferably they exhibit a 10-second shear creep compliance in the range of about $1 \times 10^{-10}$ cm²/dyne to $1 \times 10^{-12}$ cm²/dyne at room temperature. The high creep compliance materials exhibit a 10-second shear creep compliance in the range of about 50 cm²/dyne to $8 \times 10^{-8}$ cm²/dyne at room temperature, and preferably in the range of about $1 \times 10^{-2}$ cm²/dyne to about $8 \times 10^{-8}$ cm²/dyne.

The term "shear creep compliance", and method for measuring it, is described, for example, by Ferry, John D., Viscoelastic Properties of Polymers, John Wiley & Sons, Inc., New York, N. Y., 1961, Chapters 2, 5 and 6. In measuring shear creep compliance of a solid material, the material to be tested is spun-cast on a smooth film of polytetrafluoroethylene to a thickness of 500 microns. Two test pieces of equal area are then die cut from the resulting film of material and placed in a parallel plate shear creep plastometer, one piece being on each side of the center plate, with an outer plate contacting the exposed surface of each. Screws connecting the two outer plates are then tightened so as to compress the sample layers 10%. The parallel plates are placed in horizontal arrangement in an oven and one end of the center plate connected to a linear displacement voltage transformer, which in turn is connected to a chart recorder. A hook is then attached to the opposite end of the center plate, a flexible wire extending from the hook over a pulley, while the outer plates are held in fixed position. The oven is raised to the desired temperature and stabilized there at ±0.5° C., after which a suitable weight (20 to 1500 gms., whatever will both measurably deform the sample and remain within the linearity limit of the sample) is attached to the free end of the wire, and the chart recorder started. From the chart recorder the time and displacement can be read and the shear compliance, J, of the sample at a given temperature calculated from the equation $$J_{(t)} = \frac{2AX_t}{hF},$$

where $t$ is the time at which the measurement is taken, A is the area of one face of one of the material samples, h is the thickness of one of the material samples, $X_i$ is the displacement at time t (where $X_i$ is less than $h$), and F is the force due to gravitational acceleration of the mass attached to the wire connected to the middle plate. When A is expressed in cm², h in cm, $X_t$ in cm, and F in dynes, $J_{(t)}$ is given in cm²/dyne.

The shear creep compliance of liquid materials is measured according to the method described at pages 113-114 of chapter 5 of Ferry, supra, incorporated herein by reference.

Useful low shear creep compliance materials are those which have a ball and ring softening point of at least about 60° C. (preferably at least 100° C.) as measured by ASTM E:28 and a "heat deflection temperature" below about 300° C. The term "heat deflection temperature" as used herein refers to that temperature at which the material is deflected 0.010 inch using a 264 psi stress in the method of ASTM D648.

Examples of useful low shear creep compliance materials include benzil, ethylene homopolymers such as "Polywax 1000" made by the Bareco Division of Petrolite Corporation and "Microthene F", available from U.S. Industrial Chemicals Co., gum rosins (e.g., "Nelio N", available from the Glidden Chemical Co.), wood rosins (e.g., "Tenex", available from Newport Chemical Co.), wood rosin esters such as "Ester Gum PE", sold by Crosby Chemicals, Inc., esters of partially or completely hydrogenated wood rosins (e.g., "Pentalyn A", and "Pentalyn H", available from the Hercules Chemical Co.), solid $\alpha$- and $\beta$- pinene resins such as those sold under the trade names of "Alpha" and "Piccolyte", respectively, by Pennsylvania Industrial Chemicals Co., polymerized and solid partially or fully hydrogenated polymerized refinery streams; solid coumarone-indene resins (e.g., the "Piccoumarone" series sold by Pennsylvania Industrial Chemicals Co.), polycarbonate resins (e.g., "Merlon M-50", available from the Mobay Chemical Co.), polyesters (e.g., poly ($\epsilon$-caprolactone), available from the Union Carbide Chemical Co. under the trade name "PCL"); phenoxy resins (e.g., "PKHH", available from Union Carbide Corp.), glassy silicone resins (e.g., "R-5071", available from Dow Corning), glassy polystyrenes, including poly(alkyl styrenes) such as poly(t-butyl styrene), alkylated polystyrenes, poly(vinyl cyclohexane) and the like.

It is preferred that the low shear creep compliance component be a glassy material having a number average molecular weight below about 200,000. For example, glassy polystyrenes, coumarone-indene resins, and polyterpenes are preferred. Low shear creep compliance materials having softening points below 60° C. may be mixed with other low shear creep compliance materials so long as the resulting blend has a softening point of at least about 60° C.

Useful high creep compliance materials are non-volatile and have a principal glass transition temperature below about 0° C. as measured by differential thermal analysis (DTA), for example, as described in Billmeyer, F. W., Jr., *Textbook of Polymer Science*, 2nd Edition, John Wiley and Sons, Inc., New York, N. Y., 1962, pp. 121–123. Useful materials include, for example, non-volatile liquids (e.g., polymeric or non-polymeric oils), plasticizers, elastomers, and low molecular weight condensation products produced by the reaction of organic compounds catalyzed by Lewis acids (e.g., low molecular weight polyterpene resins, low molecular weight polymerized refinery streams, low molecular weight coumarone-indene resins).

Preferably, the high creep compliance component is an elastomer. Elastomers useful in the practice of this invention are typically amorphous in their unstressed condition, although it is not necessary that they be so, and may be stretched to at least about twice their unstressed length with essentially full recovery. For the purposes of this invention, the definition of elastomer from ASTM Special Technical Publication No. 184 (1956) is adopted. Elastomer is defined therein as a substance that can be stretched at room temperature to at least twice its original length, and after having been stretched and the stress removed, returns with force to approximately its original length in a short time.

Useful elastomers are normally selected from the group consisting of the natural rubbers, their synthetic analogs, halogenated rubbers obtained by the polymerization of halogen-containing monomers or by the halogenation of synthetic or naturally occurring elastomers, both linear and branched acrylate polymers and copolymers, ethylene-propylene-diene terpolymers and other ethylene and propylene copolymers, polyurethanes, silicone polymers, block polymers containing segments having glass transition temperatures below about 0° C., and other elastomers well known to those skilled in the art. Elastomers having chemical or physical cross-links are useful in this invention provided that they exhibit a shear creep compliance of more than about $8 \times 10^{-8}$ cm²/dyne.

Representative useful elastomers include natural rubbers, such as the grade known as 1-X Superior Quality rubber latex, thin plane crepe; "Natsyn 200", a synthetic polyisoprene (available from the Goodyear Tire & Rubber Co.), styrene-butadiene rubbers (available from Texas-U.S. Rubber Company under the trade name "Synpol"), polyisobutylenes (available from the Enjay Chemical Co. under the trade name "Vistanex"), EPDM rubbers such as the EPCAR(R) series sold by the B. F. Goodrich Chemical Co., silicone elastomers and the "Kraton" series of thermoplastic elastomers available from the Shell Chemical Co.

Non-volatile liquids which are useful as the high creep compliance component include silicone oils (e.g., "RTV-911", commercially available from General Electric), low molecular polystyrenes (e.g., "Piccolastic A-5", commercially available from Pennsylvania Industrial Chemicals Co.), and low molecular weight polyterpenes (e.g., "Piccolyte S-10" and "Alpha 10", commercially available from Pennsylvania Industrial Chemicals Co.).

In one preferred embodiment of the invention the high shear creep compliance material comprises an elastomer, and a tackifier for such elastomer is present as part of the binder material of the developing particles. Commonly used tackifiers, whose physical state can range from liquids to glassy materials, include partially hydrogenated rosin and rosin esters, polyterpenes, coumarone-indene resins, low molecular weight styrene polymers, and oil-soluble petroleum resins. Other useful tackifiers are well known in the art.

In another preferred embodiment of this invention at least a portion of the binder material of the developing particles comprises a copolymer which has both low shear creep compliance segments and high shear creep compliance segments. For example, useful copolymers of this type include "Kraton 1101", "GXT-0650", "Kraton 1107", commercially available from Shell Chemical Co. Such copolymers are blended with any of the low shear creep compliance materials described before to make developing powders.

In another preferred embodiment of this invention at least a portion of the binder material of the developing particles comprises a blend of a block copolymer which has both elastomeric and non-elastomeric segments and a tackifier which will tackify the elastomeric segments. For example, useful block copolymers include styrene-butadiene-styrene block copolymers (e.g., "Kraton 1101", commerciallly available from Shell Chemical Co., 29 weight percent polystyrene, 0.94 specific gravity, and a 10-second shear creep compliance of $8.3 \times 10^{-8}$ cm²/dyne, principal glass transition temperature of about −90° C.); styrene-isoprene-styrene block copolymers (e.g., "Kraton 1107", commercially available from Shell Chemical Co., 14 weight percent polyisoprene, 0.93 specific gravity, and a 10-second shear creep compliance of $1.9 \times 10^{-7}$ cm²/dyne, principal glass transition temperature of about −60° C.); and "Kraton GXT-0650", commercially available from Shell Chemical Co. (a block copolymer containing about 27% styrene and having a hydrogenated center block; glass transition temperature of about −60° C.).

When formulating developing powders of this invention using a block copolymer as the source of high shear creep compliance material, it is the volume of only the high shear creep compliance segment of the block copolymer that is taken into account in order to obtain the proper volume ratio of high creep compliance material to low creep compliance material in the binder of the resulting powder. For example, "Kraton 1101" contains about 74% by volume of high shear creep compliance segments (i.e., polybutadiene).

Various other materials may be usefully incorporated in or on the developer particles of this invention, e.g., antioxidants or other stabilizers, dyestuffs, pigments, electrically conductive particles, magnetically permeable particles, etc. Magnetically permeable particles having an average major dimension of one micron or less are particularly preferred, including magnetite, barium ferrite, nickel zinc ferrite, chromium oxide, nickel oxide, etc. A magnetically permeable core may also be used. Powdered flow agents may also be added to the dry particles to improve their flow characteristics.

Particularly useful developing powders of the invention are those exhibiting the electrical properties described in U.S. Pat. No. 3,639,245 (Nelson), incorporated herein by reference. Accordingly, preferred developing powders are those wherein electrically conductive particles are firmly anchored in the binder material of the powder, the electrically conductive particles having a conductivity of at least $10^{-2}$ mho/cm and an average diameter below about 100 millimicrons forming a radially disposed zone. The resulting electrically conductive developing particles exhibit the following properties:

a. an electronic conductivity ranging monatonically without decreasing from between about $10^{-11}$ and $10^{-4}$ mho/cm in a 100 v./cm. DC electrical field to between about $10^{-8}$ and $10^{-3}$ mho/cm in a 10,000 v./cm. DC electrical field, b. a number average particle diameter below about 20 microns, and c. a volume ratio of said electrically conductive particles to total developing particle volume of between 0.01/100 and 4/100.

The developing powder is prepared by first obtaining a blend of appropriate composition by any of several conventional techniques. For example, the binder components may be mixed together on a rubber mill, the rolls of which may be heated to facilitate the mixing process, and then colorants or other solid fillers (e.g., barium ferrite) are added and dispersed. The mixture is allowed to cool after which it is ground and classified according to the appropriate number average particle size range of about 5 to 20 microns. Alternatively, the binder components may be dissolved in a suitable solvent or mixture of solvents and fillers are then added to the solution which is concentrated with concurrent agitation until the dispersion is sufficiently thick to prevent settling of the fillers, and the dispersion may then be dried, ground and classified.

The powder may also be prepared by dissolving the binder component in an appropriate solvent or mixture of solvents which are then removed to yield a dry binder blend to which desired colorants and fillers may be admixed in a Banbury, rubber mill, or other appropriate high intensity mixer well known to those skilled in the art. After cooling, the dispersion is ground and classified.

The solid particles obtained in accordance with any of the foregoing procedures are then preferably "spheroidized" by the following method. The powder is aspirated into a moving gas stream, preferably air, to create an aerosol. This aerosol is directed perpendicular to and through a stream of hot air, which has been heated to about 900°–1100° F., in a cooling chamber where the powder is then allowed to settle by gravity while it cools. The resulting powder now comprises substantially spherical particles. The particles are then collected, such as by cyclone separation, and are preferably blended with a flow agent (e.g., "CAB-O-SIL", trade name for a finely divided silica, commercially available from the Cabot Corporation) to insure that it will be free flowing.

If the developing powder is to be used in an imaging process like that described in U.S. Pat. No. 3,563,734, the electrical properties of the particles are adjusted to the desired range by dry blending it with conductive powder (e.g., conductive carbon black) and the mixture is directed perpendicular to and through a stream of gas, preferably air, heated to a temperature (e.g., 700°–800° F.) which can at least soften and desirably melt the binder in the particles and maintain that softened or melted condition for a period of time sufficient to permit the conductive powder to become firmly anchored to the surface of the particle, prior to the classification and addition of powdered flow agents. The desired electrical properties for such developing powders are described in detail in Nelson, U.S. Pat. No. 3,639,245, incorporated herein by reference, and are also set forth above.

In order to be commercially acceptable, the resulting developing powder must exhibit a "transfer density" of less than about 0.15 and a "paper abrasion density" of less than about 0.15. The "transfer density" value for a particular developing powder is determined by first using the apparatus depicted in FIG. 1. Referring to the drawing, there is shown apparatus 10 comprising base 12 on which there is fastened an imaged copy sheet 14 (wherein the image comprises a solid black line about one inch wide) covered by an unimaged copy sheet 16. The image on sheet 14 has been made using the pressure-fixable developing powder to be tested, and sheet 16 is laid over and in direct contact with the image. Tape strips 18 and clip 20 hold sheets 14 and 16 in position.

Sheets 14 and 16 are "type 350" copy paper commercial available from 3M Company, and comprise 45 pound Weyerhauser "GRS" paper coated on one side with zinc oxide in a binder. The binder comprises a blend of acrylic resin and alkyd resin, and the ratio of zinc oxide to total binder is 6:1. The weight of dried coating on the paper is 2.2-2.4 grams per square foot.

Twelve conventional medium point ball-joint pen cartridges 22 are positioned (in free moving vertical position) within holding device 24. Four of the cartridges 22 are each vertically loaded with a weight 26 of 4.25 ounces (121 grams); four of the cartridges are loaded with a weight 28 of 8.8 ounces (250 grams); and four of the cartridges are loaded with a weight 30 of 17.3 ounces (492 grams), as shown in FIG. 1. These particular weight loadings encompass the range of writing pressures normally encountered.

Holding device 24 is then rolled across the unimaged copy sheet 16 so that each of the cartridges 22 makes an inked line on sheet 16. The holding device 24 is then indexed 1/64 inch (0.397 millimeters) laterally via indexing device 32 and threaded shaft 34 before the holding device 24 is again passed over sheet 16. This procedure is repeated until about 20–25 passes have been made over sheet 16 with the loaded cartridges 22. The number of passes should be sufficient to obtain an area large enough to permit measuring of the diffuse reflection optical density of the developing powder transferred from the solid image area of sheet 14 to the back side of sheet 16. The optical density readings are proportional to the amount of image material transferred, and the optical density reading (e.g., 0.1) is taken as the "transfer density" value for the particular powder being tested. Conventional diffuse reflection densitometers (e.g., MacBeth Quanta-Log Diffuse Reflection Densitometer, Model RD-100) can be used to measure the optical density. For the purposes of this invention useful developing powders exhibit "transfer density" of less than about 0.15 when testing image samples in the foregoing test using a pen cartridge loading of 17.3 ounces.

Figure 2:
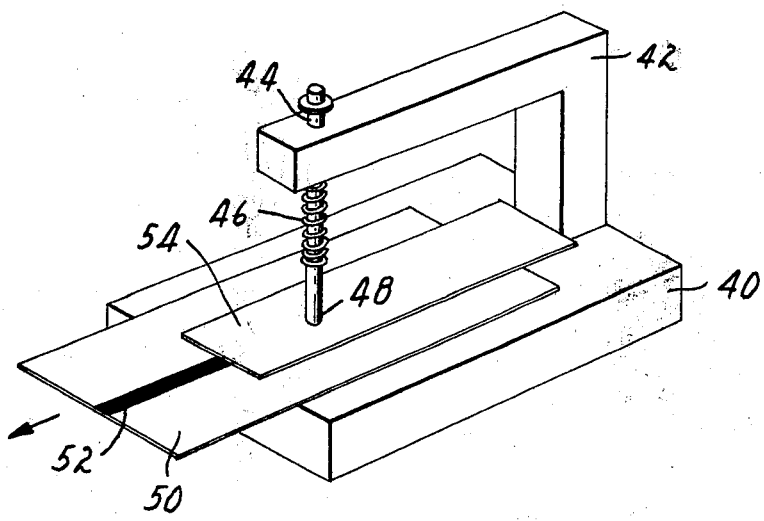
FIG. 2 contains apparatus for performing a "paper abrasion density" measurement.

The "paper abrasion density" is measured by first using the apparatus of FIG. 2 wherein there is depicted a base 40 having mounted thereon arm 42. Rod 44 is one-half inch (12.7 millimeters) in diameter and 6½ inches (16.5 centimeters) long. Rod 44 is loaded with 8 pounds of force pushing it against base 40 via spring 46. Pad 48, firmly attached to the bottom of rod 44, is formed of a silicone elastomer (hardness of 35 Shore A).

A copy sheet 50 bearing a solid image stripe 52 formed by pressure fixing the developing powder to be tested is positioned on base 40, with image side up, and 4 inches (10 centimeters) into the throat of the apparatus. Sheet 54 is then placed over and in direct contact with image 52 on sheet 50 after which rod 44 (loaded with 8 pounds force) is placed in contact with sheet 54. Then, while holding sheet 54 in its stationary position, sheet 52 is pulled in the direction of the arrow at the rate of about 2–10 inches per second for a distance of 4 inches (10 centimeters). The diffuse reflection optical density of the material transferred to the back side of sheet 54 is then measured using a conventional diffuse reflection densitometer (e.g., MacBeth Quanta-Log Diffuse Reflection Densitometer, Model RD-100). The optical density reading is taken as the "paper abrasion density" value for the particular powder being tested.

Copy sheet 50 is "Type 350" copy paper commercially available from 3M Company. Sheet 54 is a conventional 20 pounds mimeo paper ("Nekoosa Ardor" Mimeo, Sub-20) which is placed with the wire side against the image stripe in the paper abrasion density test.

The invention is illustrated by means of the following examples wherein the term "parts" refers to parts by weight unless otherwise indicated.

EXAMPLE 1

A developing powder is prepared using the following ingredients in the amounts shown:

| | Parts |
|---|---|
| "Kraton 1107" (a styrene-isoprene-styrene block copolymer elastomer, commercially available from Shell Chemical Company) | 6 |
| "Piccolastic T-135" (a polystyrene available from Pennsylvania Industrial Chemical Company, ball and ring softening point of 135° C.) | 34 |
| Magnetite | 60 |

The block copolymer and polystyrene are dissolved in 100 parts of dichloromethane after which the magnetite (0.2–0.4 micron particles) is dispersed therein. The resulting dispersion is concentrated over a stream bath (to remove solvent) with concurrent mixing until a highly viscous state is obtained. The dispersion is then dried to a brittle solid state by heating.

The solidified material is then broken into fractions and reduced to fine powder particles using a hammer mill (e.g., a "Mikro-Pulverizer" (trade name), commercially available from MikroPul Division of Slick Corp.). A fraction having a diameter less than 45 microns is then collected and blended with 0.1% by weight of a flow agent (e.g., "Aerosil", an amorphous colloidal silica commercially available from Degussa, Inc.). The binder material of the resulting dry powder comprises about 15 parts by volume of high shear creep compliance material and about 85 parts by volume of low shear creep compliance material.

The resulting dry developing powder is then used in a copying process wherein an image is formed electrographically on zinc oxide coated paper and developed using a magnetic roller of the type disclosed in U.S. Pat. No. 3,455,276 (Anderson). The developed image on the zinc oxide coated paper is then pressure fixed, for example by passing the imaged and developed paper between two smooth, polished steel rolls (approximately two inches in diameter) at a pressure of 200 pounds per lineal inch.

The resulting finished copy has sharp black image areas of high quality with no backgrounding. The transfer density of the finished copy is measured and found to be 0.00 at a pen cartridge loading of 17.3 ounces (492 grams). The paper abrasion density of the finished copy is measured and found to be 0.07.

EXAMPLE 2

A pressure-fixable developing powder is prepared using the following ingredients in the amounts stated:

| | Parts |
|---|---|
| Natural rubber (1-X superior quality rubber latex, thin pale crepe; principal glass transition temperature of −72° C. | 3.44 |
| Polystyrene (number average molecular weight of about 2,000; ball and ring softening point of approximately 100° C.) | 36.56 |
| Magnetite | 60 |

The natural rubber and the polystyrene are mixed and blended together on a heated rubber mill (e.g., 150° C.) after which the magnetite (0.2–0.4 micron particles) is added with continued mixing and blending on the rubber mill. The resulting dispersion is cooled and reduced to a powder, after which a small amount of conventional flow agent is added. The binder material of the resulting dry powder comprises about 10 parts by volume of high shear creep compliance material and about 90 parts by volume of low shear creep compliance material.

The resulting dry developing powder is then used in a copying process wherein a image is formed electrographically on zinc oxide coated paper and developed using a magnetic roller of the type disclosed in U.S. 3,455,276 (Anderson). The developed image on the zinc oxide coated paper is then pressure fixed, for example, by passing the imaged and developed paper between two smooth steel rolls at a pressure of 200 pounds per lineal inch.

The resulting finished copy has sharp black image areas of high quality with no backgrounding. The transfer density of the finished copy is measured and found to be 0.02 at a pen cartridge loading of 17.3 ounces (492 grams). The paper abrasion density of the finished copy is measured and found to be 0.13.

EXAMPLE 3

A dry, pressure-fixable developing powder is prepared with the following ingredients using the procedures of Example 1:

| | Parts |
|---|---|
| "Kraton 1101" (a styrene-butadiene-styrene block copolymer elastomer commercially available from Shell Chemical Company) | 6 |
| "Pentalyn H" (an ester of a hydrogenated wood rosin commercially available from Hercules Chemical Company, ball and ring softening point of about 100° C.) | 34 |
| Magnetite | 60 |

The binder material of the resulting dry powder comprises about 13 parts by volume of high shear creep compliance material and about 87 parts by volume of low shear creep compliance material.

The resulting dry developing powder is used to make finished copies as described in Example 1. The transfer density of such copies is measured and found to be 0.00 at a pen cartridge loading of 17.3 ounces (429 grams). The paper abrasion density is measured and found to be 0.10.

EXAMPLE 4

A dry, pressure-fixable, developing powder is prepared with the following ingredients using the procedures of Example 1:

| | Parts |
|---|---|
| "Kraton 1107" (a trade name for styrene-isoprene-styrene block copolymer elasto- | |

-continued

| | Parts |
|---|---|
| mer, commercially available from Shell Chemical Company) | 6 |
| Polystyrene (number average molecular weight of about 1,600, ball and ring softening point of about 95° C.) | 2 |
| Polystyrene (number average molecular weight of about 21,000, ball and ring softening point over 100° C.) | 34 |
| Magnetite | 60 |

The binder material of the resulting dry powder comprises about 19 parts by volume of high shear creep compliance material and about 81 parts by volume of low shear creep compliance material.

The resulting dry developing powder is used to make finished copies as described in Example 1. The transfer density of such copies is measured and found to be 0.00 at a pen cartridge loading of 17.3 ounces (492 grams). The paper abrasion density is measured and fond to be 0.15.

EXAMPLE 5

A dry, pressure-fixable developing power is prepared with the following ingredients using the procedures of Example 1:

| | Parts |
|---|---|
| "Kraton 1107" (a styrene-isoprene-styrene block copolymer elastomer, commercially available from Shell Chemical Company) | 8 |
| Silicone resin (Grade R-5071, commercially available from Dow Corning Corporation, ball and ring softening point over 100° C.) | 32 |
| Magnetite | 60 |

The binder material of the resulting developing powder comprises about 21 parts by volume of high shear creep compliance material and about 79 parts by volume of low shear creep compliance material.

The resulting dry developing powder is used to make finished copies as described in Example 1. The transfer density of such copies is measured and found to be 0.05 at a pen cartridge loading of 17.3 ounces (492 grams). The paper abrasion density is measured and found to 0.13.

EXAMPLE 6

A dry pressure-fixable developing powder is prepared with the following ingredients using the procedures of Example 1:

| | Parts |
|---|---|
| "Kraton 1107" (a styrene-isoprene-styrene block copolymer elastomer, commercially available from Shell Chemical Company) | 6 |
| Polystyrene (number average molecular weight of about 20,000, ball and ring softening point of over 100° C.) | 32 |
| "Piccolastic A-5" (a liquid polystyrene commercially available from Pennsylvania Industrial Chemical Company) | 2 |
| Magnetite | 60 |

The binder material of the resulting developing powder comprises about 20 parts by volume of high shear creep compliance material and about 80 parts by volume of low shear creep compliance material.

The resulting dry developing powder is used to make finished copies as described in Example 1. The transfer density of such copies is measured and found to be 0.02 at a pen cartridge loading of 17.3 ounces (492 grams). The paper abrasion density is measured and found to be 0.16.

EXAMPLE 7

A dry, pressure-fixable developing powder is prepared with the following ingredients using the procedures of Example 2:

| | Parts |
|---|---|
| "Synpol 1012" (a random styrene-butadiene copolymer elastomer commercially available from Texas-U.S. Rubber Company; principal glass transition temperature of about −60° C.) | 6 |
| "Alpha 135" (α-pinene resin, commercially available from Pennsylvania Industrial Chemical Company, ball and ring softening point of 135° C.) | 34 |
| Magnetite | 60 |

The binder material of the resulting developing powder comprises about 16 parts by volume of high shear creep compliance material and about 84 parts by volume of low shear creep compliance material.

The resulting dry developing powder is used to make finished copies as described in Example 2. The transfer density of such copies is measured and found to be 0.03 at a pen cartridge loading of 17.3 ounces (492 grams). The paper abrasion density is measured and found to be 0.13.

EXAMPLE 8

A dry, pressure-fixable developing powder is prepared with the following ingredients using the procedures of Example 1:

| | Parts |
|---|---|
| "Kraton 1101" (a styrene-butadiene-styrene block copolymer elastomer commercially available from Shell Chemical Company | 12 |
| "PKHH" (a phenoxy resin commercially available from Union Carbide Corporation, ball and ring softening point of over 100° C.) | 86 |
| Carbon Black (Royal Spectra, particle size of about 10 millimicrons, commercially available from Columbia Carbon Company; specific surface area of 1125 $m^2$/gram) | 1 |
| Nigrosine SS JJ (solid, oil-dispersible dye) | 1 |

The binder material of the resulting developing powder comprises about 10 parts by volume of high shear creep compliance material and about 90 parts by volume of low shear creep compliance material.

The resulting dry developing powder is deposited on a photoconductive substrate (which bears an electrostatic image) using the technique described in U.S. Pat. No. 2,940,934 (magnetic brush). The powder is then transferred by electrostatic means to plan paper upon which it is pressure fixed. The transfer density of such copies is measured and found to be 0.07 at a pen cartridge loading of 17.3 ounces (492 grams). The paper abrasion density is measured and found to be 0.12.

EXAMPLE 9

A dry, pressure-fixable developing powder is prepared with the following ingredients using the procedures of Example 1:

| | Parts |
|---|---|
| "Kraton 1107" (a styrene-isoprene-styrene block copolymer elastomer, commercially | |

-continued

| | Parts |
|---|---|
| available from Shell Chemical Company) | 19.6 |
| Cellulose acetate propionate ("PLFS-70", commercially available from Hercules Chemical Company, ball and ring softening point of over 100° C.) | 76.4 |
| Carbon Black (Royal Spectra, particle size of about 10 millimicrons, commercially available from Columbia Carbon Company, specific surface area of 1125 $m^2$/gram) | 2 |
| Nigrosine SS JJ (solid, oil-dispersible dye available from American Cyanamide) | 1 |

The binder material of the resulting developing powder comprises about 22 parts by volume of high shear creep compliance material and about 78 parts by volume of low shear creep compliance material.

The resulting dry developing powder is used to make finished copies as described in Example 8. The transfer density of such copies is measured and found to be 0.05 at a pen cartridge loading of 17.3 ounces (492 grams). The paper abrasion density is measured and found to be 0.14.

EXAMPLE 10

The developing powder of Example 4 is dusted across the surface of an electrographicallly imaged zinc-oxide coated paper to develop said image. The developed image is then pressure fixed, for example, by passing the imaged and developed paper between two smooth, polished steel rolls (approximately 2 inches in diameter) at a pressure of 200 pounds per lineal inch.

The resulting finished copy has sharp black image areas of high quality with no backgrounding. The transfer density of the finished copy is measured and found to be 0.00 at a pen cartridge loading of 17.3 ounces (492 grams). The paper abrasion density of the finished copy is measured and found to be 0.05.

EXAMPLE 11

A dry, pressure-fixable developing powder is prepared with the following ingredients using the procedures of Example 1:

| | Parts |
|---|---|
| "Kraton 1107" (a styrene-isoprene-styrene block copolymer elastomer, commercially available from Shell Chemical Company) | 8 |
| Polystyrene (number average molecular weight of about 2,000; ball and ring softening point of about 105° C.) | 32 |
| Magnetite | 53 |

After classification the specific area ($cm^2$/gram) of the particles is calculated from the particle size distribution and the particle specific gravity. The powder is then dry blended with conductive carbon ("Vulcan XC-72R", commercially available from Cabot Corporaton) in the amount of $5 \times 10^{-6}$ gram carbon per square centimeter of particle surface area, after which the particles are "spheroidized".

The binder material of the resulting dry developing powder comprises about 21 parts by volume of high shear creep compliance material and about 79 parts by volume of low shear creep compliance material.

The resulting dry developing powder is used to make finished copies as described in Example 1. The transfer density of such copies is measured and found to be 0.00 at a pen cartridge loading of 17.3 ounces (492 grams). The paper abrasion density is measured and found to be 0.04.

In the foregoing examples the following materials exhibit a 10-second shear creep compliance, at room temperature, in the range of $1 \times 10^{-9}$ $cm^2$/dyne to $1 \times 10^{-13}$ $cm^2$/dyne: "Piccolastic T-135"; polystyrene (number average molecular weights of 1,600, 2,000, 20,000, and 21,000); "Pentalyn H"; silicone resin (Grade R-5071); "Alpha 135"; "PKHH"; and cellulose acetate propionate.

In the foregoing examples the following materials exhibit a 10-second shear creep compliance, at room temperature, in the range of 50 $cm^2$dyne to $8 \times 10^{-8}$ $cm^2$/dyne: "Kraton 1107"; "Kraton 1101"; natural rubber; "Piccolastic A-5"; and "Synpol 1012".

What is claimed is:

1. Flowable, pressure-fixable, dry powder particles, the binder material of said particles having a conductivity of at most $10^{-12}$ mho/cm., said binder comprising (a) about 74 to 98 parts by volume of a thermoplastic component having a softening point of at least about 60°C., a 10-second shear creep compliance in the range of about $1 \times 10^{-12}$ $cm^2$/dyne to $1 \times 10^{-10}$ $cm^2$/dyne, and a heat deflection temperature below about 300°C., and (b) about 2 to 26 parts by volume of a non-volatile component having a principal glass transition temperature below about 0° C. and a 10-second shear creep compliance greater than about $8 \times 10^{-8}$ $cm^2$/dyne; wherein said powder exhibits a transfer density of less than about 0.15 and a paper abrasion density of less than about 0.15; wherein said non-volatile component is an elastomer selected from the group consisting of synthetic diene rubbers, acrylate rubbers, polyurethane elastomers, and rubbery block copolymers; and wherein said binder further comprises a tackifier for said elastomer.

2. A powder in accordance with claim 1 wherein said thermoplastic component is selected from the group consisting of polystyrenes, coumarone-indene resins, and polyterpenes.

3. A powder in accordance with claim 1 wherein electrically conductive particles are firmly anchored in said binder.

4. A powder in accordance with claim 5 wherein said electrically conductive particles have a conductivity of at least $10^{-2}$ mho/cm and an average diameter below about 100 millimicrons; and wherein said dry powder particles exhibit:

a. an electronic conductivity ranging monatonically without decreasing from between about $10^{-11}$ and $10^{-4}$ mho/cm in a 100 v./cm. DC electrical field to between about $10^{-8}$ and $10^{-3}$ mho/cm in a 10,000 v./cm. DC electrical field, b. a number average particles diameter below about 20 microns, and c. a volume ratio of said electrically conductive particles to total dry powders particle volume of between 0.01/100 and 4/100.

5. A powder in accordance with claim 4 wherein said electrically conductive particles of highly conductive carbon having a conductivity of at least $10^{-2}$ mho/cm.

6. A powder in accordance with claim 3 wherein said dry powder particles further contain their magnetizable particles.

7. A powder in accordance with claim 6 wherein said magnetizable particles comprise magnetite.

* * * * *

UNITED STATES PATENT AND TRADEMARK OFFICE

CERTIFICATE OF CORRECTION

PATENT NO. : 3,965,022

DATED : June 22, 1976

INVENTOR(S) : Doyle L. Strong and Curtis D. Hargadine

It is certified that error appears in the above-identified patent and that said Letters Patent are hereby corrected as shown below:

Col. 10, line 22, "a" should read -- an -- .

Col. 11, line 19, "fond" should read -- found -- .

Col. 12, line 56, "plan" should read -- plain -- .

Claim 4 should be dependent upon claim 3 instead of claim 5.

Signed and Sealed this

Nineteenth Day of October 1976

[SEAL]

*Attest:*

RUTH C. MASON
*Attesting Officer*

C. MARSHALL DANN
*Commissioner of Patents and Trademarks*